US010496016B2

(12) United States Patent
Arimura

(10) Patent No.: US 10,496,016 B2
(45) Date of Patent: Dec. 3, 2019

(54) IMAGE FORMING APPARATUS

(71) Applicant: CANON KABUSHIKI KAISHA, Tokyo (JP)

(72) Inventor: Koji Arimura, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/220,721

(22) Filed: Dec. 14, 2018

(65) Prior Publication Data

US 2019/0196365 A1 Jun. 27, 2019

(30) Foreign Application Priority Data

Dec. 22, 2017 (JP) ..... 2017-247049

(51) Int. Cl.
*G03G 15/16* (2006.01)
*G03G 15/01* (2006.01)

(52) U.S. Cl.
CPC ..... *G03G 15/161* (2013.01); *G03G 15/011* (2013.01); *G03G 15/0121* (2013.01); *G03G 15/0147* (2013.01); *G03G 2215/00059* (2013.01)

(58) Field of Classification Search
CPC ..... G03G 15/1675; G03G 15/163; G03G 15/2028; G03G 15/011; G03G 15/0121; G03G 15/0147
See application file for complete search history.

(56) References Cited

U.S. PATENT DOCUMENTS

| | | | | |
|---|---|---|---|---|
| 7,720,400 | B2 | 5/2010 | Taguchi et al. | |
| 9,612,557 | B2 | 4/2017 | Yuasa | |
| 2010/0303488 | A1* | 12/2010 | Yanagi | G03G 15/065 399/45 |
| 2010/0316401 | A1* | 12/2010 | Gomi | G03G 15/065 399/49 |

FOREIGN PATENT DOCUMENTS

| | | | |
|---|---|---|---|
| JP | 2007-047554 | A | 2/2007 |
| JP | 2014-235269 | A | 12/2014 |
| JP | 2016-062046 | A | 4/2016 |
| JP | 2016-095333 | A | 5/2016 |

* cited by examiner

*Primary Examiner* — Walter L Lindsay, Jr.
*Assistant Examiner* — Jessica L Eley
(74) *Attorney, Agent, or Firm* — Venable LLP

(57) ABSTRACT

An image forming apparatus is configured to execute a first image forming mode, in which an image is formed by forming toner images on a first photosensitive member and a second photosensitive member, and a second image forming mode, in which an image is formed by releasing the first photosensitive member from an outer peripheral surface of an intermediate transfer member and bringing the second photosensitive member into abutment against the outer peripheral surface of the intermediate transfer member. A control unit is configured to set a potential difference, which is a difference between an absolute value of a dark point potential of the second photosensitive member and an absolute value of a direct current component of a developing bias, to be lower in a case of the second image forming mode than in a case of the first image forming mode.

6 Claims, 10 Drawing Sheets

FIG. 7

| | DRUM POTENTIAL Vd ON DEVELOPING POSITION | DEVELOPING SLEEVE POTENTIAL Vdc | FOG-REMOVING CONTRAST Vback | FOGGING TONER AMOUNT | SUB SCANNING DIRECTION OF UNTRANSFERRED TONER | UNTRANSFERRED TONER SUPPLY FREQUENCY | CLEANING BLADE CURL |
|---|---|---|---|---|---|---|---|
| EMBODIMENT 1 | -600V | -500V | 100V | 1.30% | — | NON | NON |
| CONVENTIONAL | -650V | -500V | 150V | 0.30% | — | NON | GENERATE |
| COMPARATIVE EXAMPLE 1 | -650V | -500V | 150V | 0.30% | 10mm | 100 SHEET | GENERATE |
| COMPARATIVE EXAMPLE 2 | -650V | -500V | 150V | 0.30% | 10mm | 30 SHEET | NON |
| COMPARATIVE EXAMPLE 3 | -650V | -500V | 130V | 0.70% | — | NON | GENERATE |

IMAGE FORMING APPARATUS

BACKGROUND OF THE INVENTION

Field of the Invention

The present invention relates to an image forming apparatus such as a copying machine, a printer, a facsimile machine, or a multifunctional apparatus having a plurality of functions thereof.

Description of the Related Art

Hitherto, in an image forming apparatus employing an electrophotography system or other systems, there has been proposed a technology of supplying toner as lubricant to a cleaning blade in order to suppress curling and abrasion of the cleaning blade on an intermediate transfer belt (see Japanese Patent Application Laid-Open No. 2007-47554).

Incidentally, in the image forming apparatus, in some cases, as well as a toner image obtained by developing an electrostatic latent image, fogged toner adhering to a photosensitive drum is transferred onto the intermediate transfer belt due to a potential difference between a charging potential on the photosensitive drum and a developing potential of a developing device, and thus the fogged toner is supplied to the cleaning blade.

Meanwhile, there is known a full color image forming apparatus capable of executing a full color mode (first image forming mode), in which a toner image is formed by a plurality of image forming units, and a monochrome mode (second image forming mode), in which a toner image is formed by one image forming unit. Further, some full color image forming apparatus employ a configuration in which, in a case of the monochrome mode, in which the toner image is formed by one image forming unit, other image forming units not to be used for forming the toner image are released from the intermediate transfer member in order to prevent the other image forming units from being unnecessarily reduced in lifetime. In such image forming apparatus, fogged toners for a plurality of colors are supplied to the cleaning blade in the full color mode, while only a fogged toner for one color is supplied to the cleaning blade in the monochrome mode. Therefore, in the monochrome mode, the amount of fogged toner to be supplied to the cleaning blade is smaller than that in the full color mode, and thus an abutment state of the cleaning blade against the intermediate transfer belt is likely to become unstable. In the image forming apparatus, when the abutment state of the cleaning blade against the intermediate transfer belt becomes unstable, for example, curling, abrasion, and chattering (abnormal vibration) of the cleaning blade is likely to occur.

SUMMARY OF THE INVENTION

In view of the above, the present invention has an object to provide an image forming apparatus capable of suppressing an unstable abutment state of a cleaning blade when a second image forming mode is executed.

An image forming apparatus of the present invention comprises: (1) a first image forming unit including: a first photosensitive member; a first charging member configured to charge the first photosensitive member to have a predetermined surface potential; a first exposure device configured to subject the first photosensitive member to image exposure in accordance with image data to form an electrostatic image; and a first developing device, to which a developing bias is to be applied, and which is configured to develop the electrostatic image formed on the first photosensitive member, the first image forming unit being configured to form a toner image on the first photosensitive member; (2) a second image forming unit including: a second photosensitive member; a second charging member configured to charge the second photosensitive member to have a predetermined surface potential; a second exposure device configured to subject the second photosensitive member to image exposure in accordance with image data to form an electrostatic image; and a second developing device, to which a developing bias is to be applied, and which is configured to develop the electrostatic image formed on the second photosensitive member; (3) an endless intermediate transfer member, to which the toner image is to be transferred from each of the first photosensitive member and the second photosensitive member; (4) a cleaning blade brought into abutment against an outer peripheral surface of the endless intermediate transfer member in a rotation direction of the endless intermediate transfer member to remove a substance adhering on the outer peripheral surface of the endless intermediate transfer member; and (4) a control unit configured to execute: a first image forming mode, in which an image is formed by bringing the first photosensitive member and the second photosensitive member into abutment against the outer peripheral surface of the endless intermediate transfer member and forming the toner image on each of the first photosensitive member and the second photosensitive member; and a second image forming mode, in which an image is formed by releasing the first photosensitive member from the outer peripheral surface of the endless intermediate transfer member and stopping drive of the first photosensitive member and the first developing device, and by bringing the second photosensitive member into abutment against the outer peripheral surface of the endless intermediate transfer member and forming the toner image on the second photosensitive member, wherein the control unit is configured to set a potential difference, which is a difference between an absolute value of a dark point potential of the second photosensitive member charged by the second charging member and an absolute value of a direct current component of a developing bias to be applied to the second developing device, to have different values between the first image forming mode and the second image forming mode, and wherein the control unit is configured to execute a setting mode in which, when the potential difference to be set in the first image forming mode is referred to as a first potential difference, the potential difference to be set in the second image forming mode is set to a second potential difference, which is smaller than the first potential difference.

Further features of the present invention will become apparent from the following description of exemplary embodiments with reference to the attached drawings.

BRIEF DESCRIPTION OF THE DRAWINGS

FIG. 7 is a table for summarizing conditions and whether or not a curl is generated in the cleaning blade in each of Embodiment, Conventional Example, and Comparative Examples 1 to 3.

DESCRIPTION OF THE EMBODIMENTS

An image forming apparatus according to each of embodiments of the present invention is described below with reference to the drawings. In the following description, upper, lower, left, and right directions are represented based on a point viewing the image forming apparatus from a front surface thereof (point of sight of FIG. 1).

First Embodiment

[Image Forming Apparatus]

Figure 1:
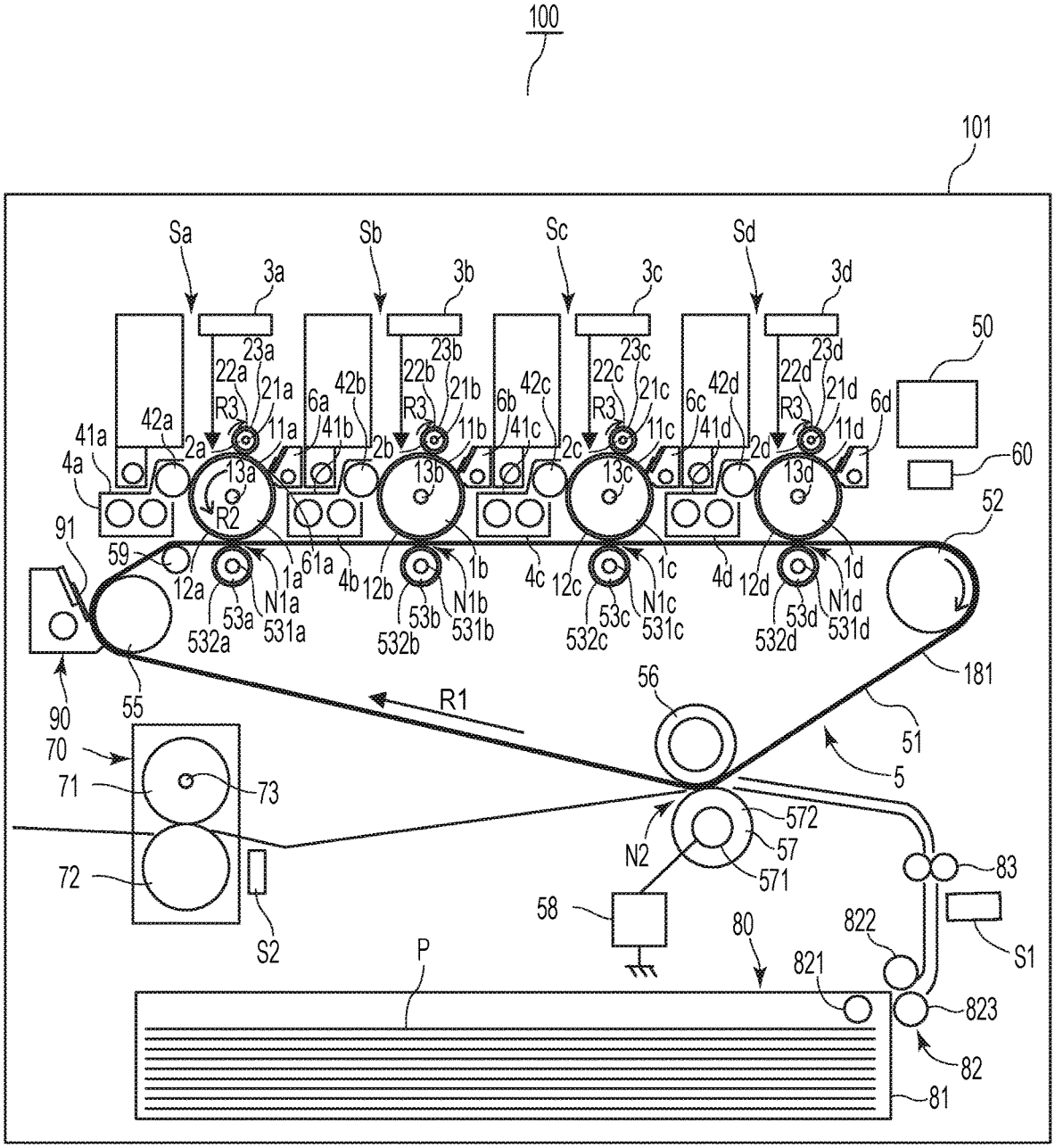
FIG. 1 is a schematic configuration view for illustrating an image forming apparatus according to a first embodiment of the present invention.

An image forming apparatus 100 according to a first embodiment of the present invention is a full-color electrophotographic image forming apparatus employing an intermediate transfer system, which includes four photosensitive drums as in the schematic configuration illustrated in FIG. 1. The image forming apparatus 100 includes, as image forming means for forming a toner image, four image forming units (process units) Sa, Sb, Sc, and Sd corresponding to toner colors of yellow, magenta, cyan, and black, respectively.

Below the image forming units Sa, Sb, Sc, and Sd, an intermediate transfer belt 51, which is a circularly-movable belt member, is arranged as an intermediate transfer member. The intermediate transfer belt 51 is an endless belt member, which is looped around a drive roller 52, a driven roller 55, a secondary transfer inner roller 56, and a guide roller 59, which serve as a plurality of support members. The intermediate transfer belt 51 rotates in a rotation direction indicated by an arrow R1. The drive roller 52 is connected to a drive motor 521 (see FIG. 2), and causes the intermediate transfer belt 51 to rotate at a predetermined rotation speed (for example, 250 mm/s).

On an inner peripheral side of the intermediate transfer belt 51, primary transfer rollers 53*a*, 53*b*, 53*c*, and 53*d* are arranged so as to be opposed across the intermediate transfer belt 51 to photosensitive drums 1*a*, 1*b*, 1*c*, and 1*d*, respectively, provided in the respective image forming units Sa to Sd. The primary transfer rollers 53*a* to 53*d* bias the intermediate transfer belt 51 toward the photosensitive drums 1*a* to 1*d*, and form primary transfer portions N1*a*, N1*b*, N1*c*, and N1*d* (primary transfer nips, primary transfer positions) as nip portions between the intermediate transfer belt 51 and the photosensitive drums 1*a* to 1*d*, respectively. Toner images formed by the image forming units Sa to Sd are transferred onto the intermediate transfer belt 51 (through multilayer transfer) while being aligned so as to be superimposed on each other at the primary transfer portions N1*a* to N1*d*, and thus a full color toner image is formed on the intermediate transfer belt 51. As described above, the intermediate transfer belt 51 is configured so that the toner images can be primarily transferred onto the intermediate transfer belt 51 from the photosensitive drums 1*a* to 1*d*.

The secondary transfer inner roller 56 is in contact with an inner peripheral surface of the intermediate transfer belt 51, and is rotated along with the movement of the intermediate transfer belt 51. Further, the secondary transfer inner roller 56 is arranged so as to be opposed across the intermediate transfer belt 51 to a secondary transfer outer roller 57, which is in contact with an outer peripheral surface of the intermediate transfer belt 51. The secondary transfer inner roller 56 forms a secondary transfer portion N2 (secondary transfer nip, secondary transfer position) as a nip portion between the secondary transfer outer roller 57 and the intermediate transfer belt 51. Further, the secondary transfer inner roller 56 is electrically grounded.

The secondary transfer outer roller 57 includes a metal core 571 having an outer diameter of 10 mm, and a conductive EPDM-rubber sponge layer 572 having a thickness of 4 mm. The secondary transfer outer roller 57 is connected to a secondary transfer bias source 58, which is provided on, for example, a high-voltage output board of an apparatus main body 101, so as to be applied with a secondary transfer bias voltage. The toner image borne by the intermediate transfer belt 51 is transferred onto a recording material P at the secondary transfer portion N2.

The secondary transfer outer roller 57 has an electrical resistance value of substantially $10^8\Omega$. In this case, the electrical resistance value of the secondary transfer outer roller 57 is obtained from a current value measured after rotating the secondary transfer outer roller 57, which is brought into abutment against a metal roller grounded under a load of 500 gf, at a peripheral speed of 50 mm/sec and applying a voltage of 500 V to the metal core 571.

In the image forming apparatus 100 according to the first embodiment, the secondary transfer bias source 58 applies the secondary transfer bias voltage having a polarity (second polarity, positive polarity in the first embodiment) that is opposite to an original charging polarity (first polarity, negative polarity in the first embodiment) of toner. Further, in the image forming apparatus 100, an electric field is formed between the secondary transfer inner roller 56 and the secondary transfer outer roller 57 in such a direction as to cause the negative-polarity toner to move toward the recording material P from the surface of the intermediate transfer belt 51. In this manner, the toner image formed on the intermediate transfer belt 51 (on the intermediate transfer member) is transferred (secondarily transferred) onto the recording material P. The recording material P having the toner image transferred thereon at the secondary transfer portion N2 is conveyed to a fixing device 70 serving as a fixing unit.

Foreign matters such as toner (secondary transfer residual toner) remaining on the outer peripheral surface of the intermediate transfer belt 51 after the secondary transfer and paper dust adhering on the outer peripheral surface of the intermediate transfer belt 51 are removed by a cleaning blade 91 of an intermediate transfer member cleaning unit 90, and are collected into the intermediate transfer member cleaning unit 90.

The cleaning blade 91 is brought into abutment against the outer peripheral surface of the intermediate transfer belt 51 on the upstream of the primary transfer portions N1*a* to N1*d* and on the downstream of the secondary transfer portion N2 in the rotation direction of the intermediate transfer belt 51. The cleaning blade 91 is a blade member made of a urethane resin or other materials, and is brought into pressure-contact with the surface of the intermediate transfer belt 51 at a predetermined angle and a predetermined pressure. The cleaning blade 91 used in the first embodiment is formed by molding urethane rubber having a hardness of about 75 degrees to have a thickness of about 2.0 mm, a free length of about 8.0 mm, and a width in a main scanning direction (width direction of the intermediate transfer belt 51) of about 330 mm. It is preferred to bring a leading end of the cleaning blade 91 in the first embodiment into abutment against the intermediate transfer belt 51 looped around the driven roller 55 at an angle (abutment angle) of 25° in a circumferential direction of the intermediate transfer belt 51. Further, it is preferred to press the cleaning blade 91 in the first embodiment toward the inner side of the intermediate transfer belt 51 in the thickness direction at a force (abutment pressure) of about 1,300 gf in total. The configuration of the intermediate transfer member cleaning unit 90 and the configuration of the cleaning blade 91 are not limited to the configurations described in the first embodiment, and may be optimized for the image forming apparatus to which the intermediate transfer member cleaning unit 90 and the cleaning blade 91 are mounted.

The image forming apparatus 100 according to the first embodiment includes an intermediate transfer unit 5 including the intermediate transfer belt 51, the primary transfer rollers 53*a* to 53*d*, the secondary transfer inner roller 56, the secondary transfer outer roller 57, and the intermediate transfer member cleaning unit 90.

In addition, the image forming apparatus 100 includes a feeding device 80, a registration roller pair 83, and the fixing device 70. The feeding device 80 includes a feeding cassette 81, on which recording materials P such as printing sheets or OHP films are stacked, and a feeding unit 82 including a pick-up roller 821, a feed roller 822, and a retard roller 823. The recording materials P stacked on the feeding cassette 81 are fed out by the pick-up roller 821 to be conveyed by the feed roller 822 toward the registration roller pair 83. A drive force in a direction reverse to a conveyance direction of the recording material P is input to the retard roller 823, and, of the recording materials P having reached a nip portion between the retard roller 823 and the feed roller 822, recording materials P excluding the uppermost sheet are pushed and returned to the feeding cassette 81.

The registration roller pair 83 corrects a skew feed of the recording material P when a leading edge of the recording material P abuts against the registration roller pair 83, and conveys the recording material P to the secondary transfer portion N2 in synchronization with timing to transfer the toner image at the secondary transfer portion N2. The fixing device 70 includes a fixing roller 71 arranged so as to be freely rotatable, a pressure roller 72 configured to rotate while being brought into pressure-contact with the fixing roller 71, and a heater 73 configured to heat the fixing roller 71. The heater 73 is, for example, a halogen lamp arranged inside of the fixing roller 71. The heater 73 is supplied with an appropriately-adjusted voltage to adjust a temperature of a surface of the fixing roller 71 and keep the surface at a predetermined temperature. The fixing roller 71 and the pressure roller 72 apply substantially constant pressure and heat to both front and back surfaces of the recording material P to melt and fix toner particles so that an image is fixed to the recording material P.

The recording material P having the image fixed thereon passes through a delivery device provided on the downstream of the fixing device 70 to be delivered to a delivery tray exposed to the outside of the apparatus main body 101. Further, when the image forming apparatus 100 ends an operation of forming the toner image onto the recording material P, the image forming apparatus 100 performs idling until a predetermined time period elapses and then stops, in order to remove transfer residual toner and eliminate charges on the surfaces of the photosensitive drums 1*a* to 1*d*.

The image forming apparatus 100 includes conveyance position sensors S1 and S2 arranged as detection units capable of detecting presence or absence of the recording material P at predetermined positions on a conveyance path of the recording material P from the feeding cassette 81 to the delivery tray. In the first embodiment illustrated in FIG. 1, the conveyance position sensors S1 and S2 are arranged at a position on the upstream of the registration roller pair 83 (pre-registration sensor) and a position on the upstream of the fixing device 70 (pre-fixing sensor), respectively. Those conveyance position sensors are not limited to be arranged at the illustrated positions, and the number of conveyance position sensors to be installed and the installation positions may be changed in accordance with, for example, a size of the recording material P on which an image is to be formed.

[Image Forming Unit]

Next, the configurations of the image forming units Sa to Sd are described with reference to the yellow image forming unit Sa as an example. The cyan, magenta, and black image forming units Sb, Sc, and Sd have configurations similar to that of the yellow image forming unit Sa except for the difference in toner color. Therefore, for elements having configurations and actions similar to those of the image forming unit Sa, a suffix "b", "c", or "d" is added to the end of the reference numeral, and description thereof is omitted. In the first embodiment, the four image forming units Sa to Sd are arranged in the order of yellow, cyan, magenta, and black along the rotation direction of the intermediate transfer belt 51 (direction of the arrow R1), but the arrangement may be changed, and the number of colors and the combination thereof are not limited to those in the first embodiment.

As illustrated in FIG. 1, the image forming unit Sa includes the photosensitive drum 1*a* serving as an image bearing member, a charging roller 2*a* serving as a charging member, a laser scanner 3*a* serving as an electrostatic latent image forming unit, a developing device 4*a* serving as a developing unit, and a drum cleaner 6*a*. The photosensitive drum 1*a* serving as the image bearing member configured to bear a toner image is rotatable in a direction (direction of an arrow R2) along the rotation direction of the intermediate transfer belt 51. The charging roller 2*a*, the laser scanner 3*a*, the developing device 4*a*, the primary transfer roller 53*a*, and the drum cleaner 6*a* serving as a drum cleaning unit are arranged in the stated order around the photosensitive drum 1*a* along the rotation direction of the photosensitive drum 1*a*.

The photosensitive drum 1*a* is a cylindrical electrophotographic photosensitive member, which is supported by the apparatus main body 101 so as to be freely rotatable, and has a basic configuration including a conductive base member 11*a* made of, for example, aluminum, and a photoconductive layer 12*a* formed on an outer periphery of the conductive base member 11*a*. The photosensitive drum 1*a* is driven to rotate about a support shaft 13*a*, which is connected to be driven by a drive source (not shown), at a peripheral speed (250 mm/s) in accordance with the rotation speed of the intermediate transfer belt 51 in the direction of the arrow R2 in FIG. 1. In the first embodiment, the photosensitive drum 1*a* has a negative charging polarity, and the diameter of the photosensitive drum 1*a* is 30 mm.

The charging roller 2*a* arranged above the photosensitive drum 1*a* is a roller member including a conductive metal core 21*a* inserted at the center of the roller member, a middle-resistance conductive layer 23*a* formed at an outer peripheral portion of the roller member, and a low-resistance conductive layer 22*a* formed between the metal core 21*a* and the middle-resistance conductive layer 23*a*. The charging roller 2*a* is arranged in parallel to the photosensitive drum 1*a*, and is supported by bearing members (not shown) at both end portions of the metal core 21*a* so as to be freely rotatable. The bearing members are biased toward the photosensitive drum 1*a* by pressing units (not shown). The charging roller 2*a* is brought into pressure-contact with the surface of the photosensitive drum 1*a* at a predetermined pressing force. The charging roller 2*a* is rotated in accordance with the rotation of the photosensitive drum 1 in a direction indicated by an arrow R3.

The metal core 21*a* of the charging roller 2*a* is electrically connected to a charging bias source 24*a* (see FIG. 2) provided to the apparatus main body 101, and is applied with a predetermined charging bias voltage (charging voltage). When the charging roller 2*a* is brought into contact with the surface of the photosensitive drum 1*a*, the surface of the photosensitive drum 1*a* is uniformly charged to have a predetermined polarity and a predetermined potential. The charging bias voltage to be used is obtained by, for example, superimposing an AC voltage having an amplitude of two times or more of that of a discharge start voltage in the environment on a DC voltage of −500 V. In this case, the surface of the photosensitive drum 1*a* is uniformly charged through contact charging at a potential of about −500 V. The DC voltage to be applied during image formation is not limited to this value, and may be appropriately set to a potential suitable for satisfactory image formation depending on the environment (for example, temperature and humidity) and cumulative usage situations of the photosensitive drum 1*a* and the charging roller 2*a*.

The laser scanner 3*a* scans the surface of the photosensitive drum 1*a* while turning off or on laser light based on image data, and exposes the photoconductive layer 12*a* of the photosensitive drum 1*a* with light (performs image exposure). In this manner, in the image forming unit Sa, surface charges applied by the charging roller 2*a* are eliminated, and an electrostatic image (latent image) corresponding to the image data is formed on the surface of the photosensitive drum 1*a*.

The developing device 4*a* serving as the developing unit configured to supply toner to the photosensitive drum 1*a* includes a developing container 41*a* configured to store developer, and a developing sleeve 42*a*. The developing device 4*a* stores two-component developer containing non-magnetic toner particles (toner) and magnetic carrier particles (carrier) as the developer. The developing sleeve 42*a* is arranged at an opening portion of the developing container 41*a*, which is opened toward the photosensitive drum 1*a*, and forms a developing region, in which toner is to be passed from the developing sleeve 42*a* to the photosensitive drum 1*a*, between the developing sleeve 42*a* and the photosensitive drum 1*a*.

The developing sleeve 42*a* is connected to a developing bias source 48*a* (see FIG. 2), and is applied with a developing bias voltage (developing voltage) obtained by superimposing an AC voltage on a DC voltage having the same polarity as the original charging polarity of the toner. In this manner, in the image forming unit Sa, the toner carried by the developing sleeve 42*a* is moved to the photosensitive drum 1*a* side in the developing region, and the electrostatic image on the photosensitive drum 1*a* is visualized (developed) as the toner image. An alternating current component of the developing bias voltage to be used in the first embodiment is a square wave (AC bias) having a frequency of 10 KHz and an amplitude of 1,000 V.

The primary transfer roller 53*a* is a roller member including a metal core 531*a* having an outer diameter of 8 mm, and a conductive layer 532*a* formed of a cylindrical conductive urethane sponge layer having a thickness of 4 mm, which is formed on an outer peripheral side of the metal core 531*a*. The primary transfer roller 53*a* is biased toward the photosensitive drum 1*a* with pressing members (not shown) such as springs connected to both end portions of the primary transfer roller 53*a*. In this manner, the primary transfer roller 53*a* brings the intermediate transfer belt 51 into pressure-contact with the photosensitive drum 1*a* at a predetermined pressing force at the primary transfer portion N1*a*. Under a state in which the primary transfer roller 53*a* is in contact with an inner peripheral surface of the intermediate transfer belt 51, the primary transfer roller 53*a* is rotated in accordance with the rotation of the intermediate transfer belt 51.

The metal core 531*a* is connected to a primary transfer bias source 54*a* (see FIG. 2), and is applied with a primary transfer bias voltage having a polarity opposite to the charging polarity of the toner. In the image forming unit Sa in the first embodiment, the toner has a negative charging polarity, and the primary transfer bias voltage has a positive polarity. In this manner, at the primary transfer portion N1*a*, a bias electric field for moving the charged toner particles toward the primary transfer roller 53*a* is formed, and the toner image borne by the photosensitive drum 1*a* is transferred (primarily transferred) onto the surface of the intermediate transfer belt 51.

The primary transfer roller 53*a* has an electrical resistance value of substantially $10^7\Omega$. In this case, the electrical resistance value of the primary transfer roller 53*a* is obtained from a current value measured after rotating the primary transfer roller 53*a*, which is brought into abutment against a metal roller grounded under a load of 500 gf, at a peripheral speed of 50 mm/sec and applying a voltage of 500 V to the metal core 531*a*.

The drum cleaner 6*a* configured to clean the surface of the photosensitive drum 1*a* brings a cleaning blade 61*a* into pressure-contact with the surface of the photosensitive drum 1*a* so as to remove adhering substances such as toner (primary transfer residual toner) remaining on the surface of the photosensitive drum 1*a*. The cleaning blade 61*a* is a blade member made of a urethane resin or other materials, and is brought into pressure-contact with the surface of the photosensitive drum 1*a* at a predetermined angle and a predetermined pressure. The cleaning blade 61*a* used in the first embodiment is formed by molding urethane rubber having a hardness of about 75 degrees to have a thickness of about 2.0 mm, a free length of about 8.0 mm, and a width in the main scanning direction (axial direction of the photosensitive drum 1*a*) of about 320 mm. It is preferred to bring a leading end of the cleaning blade 61*a* in the first embodiment into abutment against the photosensitive drum 1*a* at an angle (abutment angle) of 25° in a circumferential direction of the photosensitive drum 1*a*. Further, it is preferred to press the cleaning blade 61*a* in the first embodiment toward the inner side of the photosensitive drum 1*a* in the radial direction at a force of about 1,300 gf in total. Adhering substances scraped off from the photosensitive drum 1*a* by the cleaning blade 61*a* are collected into the drum cleaner 6*a*, and are conveyed by a conveyance screw inside of the drum cleaner 6*a*. Then, the substances are discharged to a waste toner container (not shown) provided in the apparatus main body 101.

[Intermediate Transfer Belt]

Next, the endless intermediate transfer belt 51 is described. The intermediate transfer belt 51 is a belt member formed of a resin layer 181. As a resin material forming the resin layer 181 of the intermediate transfer belt 51, there can be used, for example, polycarbonate, a fluorine-based resin (ETFE or PVDF), or a polyimide resin.

The resin material forming the resin layer 181 of the intermediate transfer belt 51 is not limited to the above-mentioned materials. Further, the intermediate transfer belt 51 is not limited to a belt formed of a single-layer resin layer, and may be formed of a two-layer or three-layer structure including a surface layer and an elastic layer. When the intermediate transfer belt 51 is formed of a two-layer or three-layer structure, it is desired that the surface layer of the intermediate transfer belt 51 be made of a material capable of reducing a toner adhering force to increase secondary transfer performance of the surface of the intermediate transfer belt 51. As a material capable of reducing the surface energy to increase lubricity, there can be used, for example, a fluororesin or a fluorine compound.

A resistance value adjustment conducting agent is added to the resin layer 181 of the intermediate transfer belt 51. As the resistance value adjustment conducting agent, for example, carbon black or metal powder is used.

The intermediate transfer belt 51 used in the first embodiment is made of a polyimide (PI) resin having a surface resistivity of $10^{12}\Omega/\square$ and a thickness of 100 μm. The value of the surface resistivity is a value measured by using a probe in conformity with JIS-K6911 under conditions of an application voltage of 100 V, an application time of 60 sec, and 23° C./50% RH.

[Cleaning Blade]

In the image forming apparatus 100, toner remaining on the intermediate transfer belt 51 after the secondary transfer functions as lubricant at the time when the cleaning blade 91 cleans the intermediate transfer belt 51. In such an image forming apparatus 100, it is required to remove, with use of the cleaning blade 91, a large amount of toner such as transfer residual toner remaining after an entire-surface solid image is transferred onto the recording material P or a patch image for image density correction or color shift correction. Further, in the image forming apparatus 100, when only a small amount of toner, such as toner in a partial character image, reaches the cleaning blade 91 as the lubricant, it is required to maintain the sliding property of the cleaning blade 91 with respect to the intermediate transfer belt 51.

In recent years, in the image forming apparatus 100, the lifetime of the intermediate transfer belt 51 has been increased. The surface of the intermediate transfer belt 51 is smoothed due to long-time use, and adhering substances are increased due to reduced surface abrasion amount. Thus, the sliding property of the cleaning blade 91 tends to decrease. Further, in the image forming apparatus 100, due to reduction in toner particle diameter and formation of spherical toner particles, the abutment pressure of the cleaning blade 91, which is required for cleaning the intermediate transfer belt 51 by the cleaning blade 91, is increased, and thus a load to be applied to the cleaning blade 91 tends to increase. Therefore, in the image forming apparatus 100, it is required to leave an appropriate amount of secondary transfer residual toner on the intermediate transfer belt 51 so that the secondary transfer residual toner is conveyed to the cleaning blade 91.

In the image forming unit Sa, toner having normal charges (negative charges) on the developing sleeve 42*a* flies toward a part of the photosensitive drum 1*a*, which is exposed by the laser scanner 3*a* (part having an image portion potential V1 of the photosensitive drum 1*a*). At this time, in the image forming unit Sa, toner (fogged toner) having charges different from the normal charges on the developing sleeve 42*a* (charges that are positive or negative but are close to 0) flies toward a part other than the exposed part. That is, in the image forming apparatus 100, toner to be supplied to the cleaning blade 91 includes not only toner that has flown to the exposed part of the photosensitive drum 1*a* and remains even after the secondary transfer but also fogged toner. The fogged toner is described in more detail later.

[Operation of Image Forming Unit]

Figure 2:
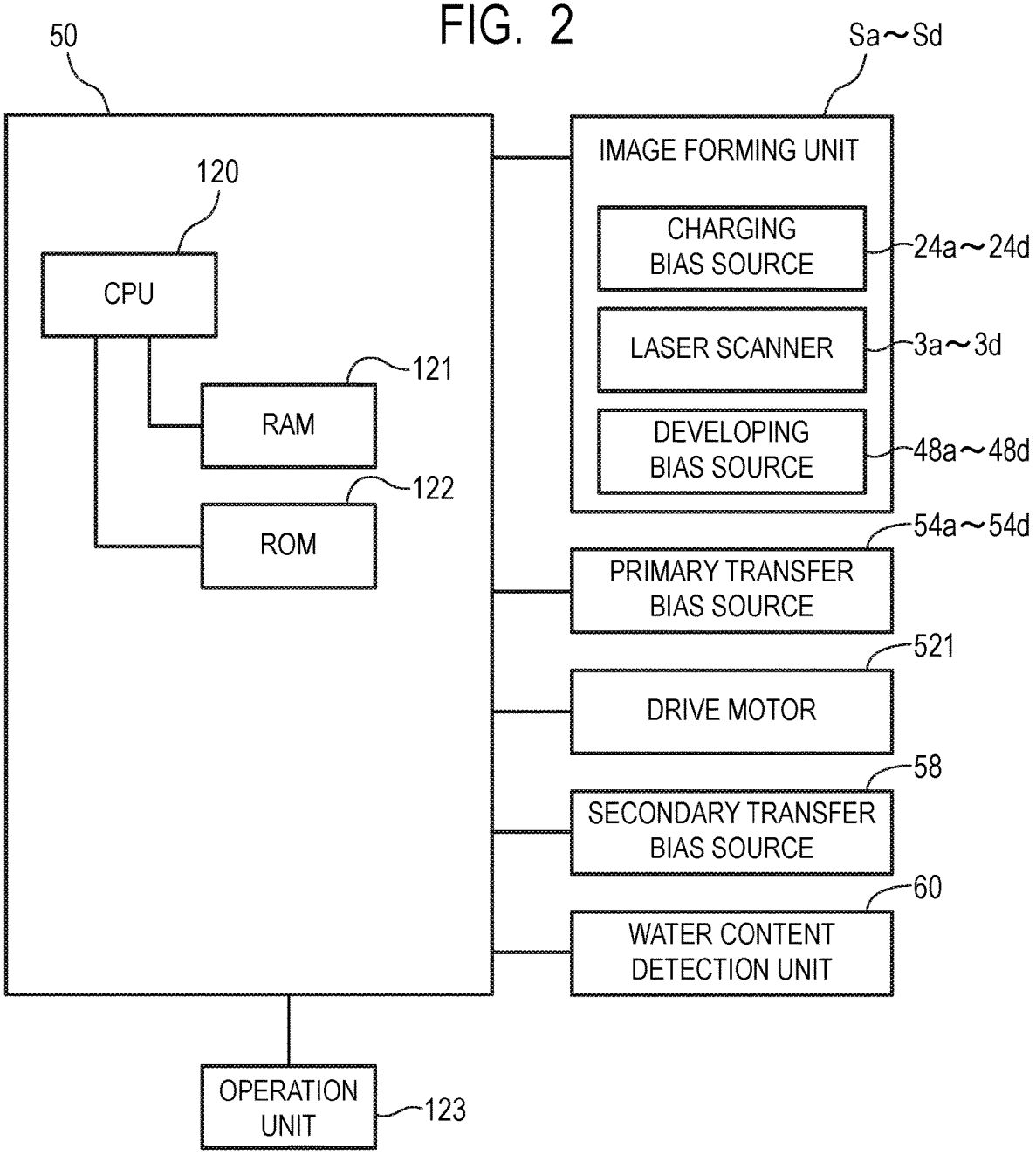
FIG. 2 is a control block diagram for illustrating the image forming apparatus.

FIG. 2 is a control block diagram for illustrating the image forming apparatus 100 according to the first embodiment. As illustrated in FIG. 1 and FIG. 2, the apparatus main body 101 of the image forming apparatus 100 includes a control circuit 50 serving as a control unit configured to control the operation of the image forming unit Sa. The control circuit 50 includes an arithmetic unit (CPU) 120, a RAM 121, and a ROM 122, and is configured to execute a control process for controlling each device by reading out a program or a setting value stored in the ROM 121 to the RAM 122.

The CPU 120 controls the charging bias voltage of the charging bias source 24*a* and a direct current component Vdc of the developing bias voltage of the developing bias source 48*a* based on the setting values of the charging bias voltage and the direct current component of the developing bias voltage, which are stored in the ROM 121 and the RAM 122.

Figure 3:
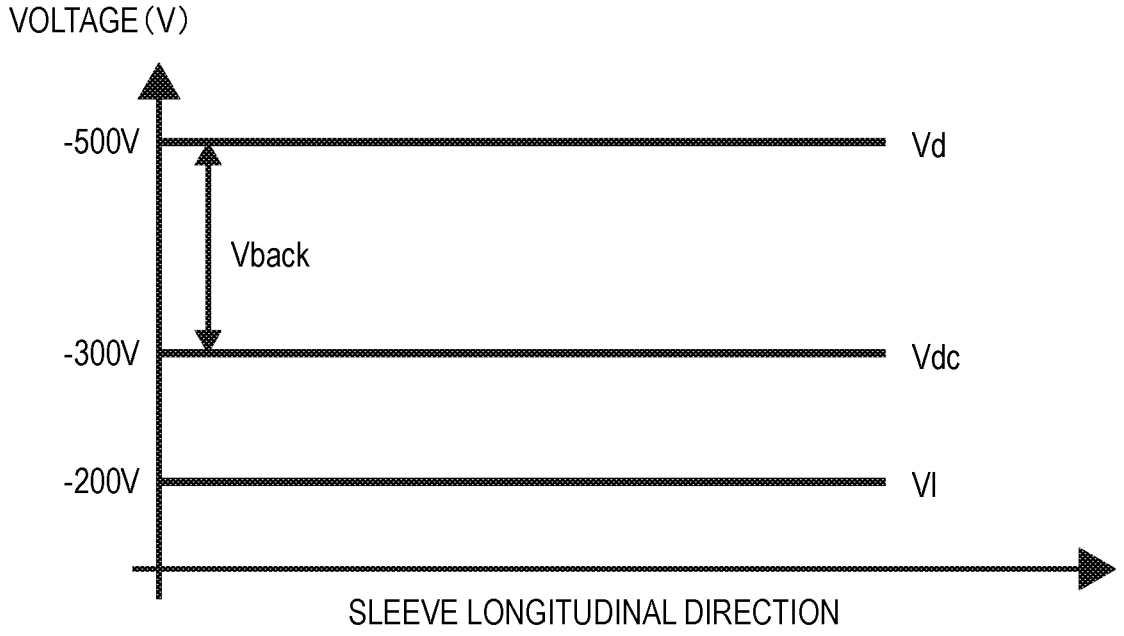
FIG. 3 is a graph for showing a charging potential and a developing potential.

FIG. 3 is a graph for showing a potential of the surface of the photosensitive drum 1*a* and a potential of the surface of the developing sleeve 42*a* under a state in which the charging bias voltage and the developing bias voltage are controlled by the CPU 120 and the surface is exposed by the laser scanner 3*a*. As shown in FIG. 3, the CPU 120 in the first embodiment controls the charging bias voltage so that a potential (background portion potential) Vd of the surface of the photosensitive drum 1*a* becomes −500 V. Further, the CPU 120 controls the developing bias voltage so that the direct current component Vdc of a potential (developing potential) of the surface of the developing sleeve 42*a* becomes −300 V Further, the CPU 120 controls the laser scanner 3*a* so that the potential (image portion potential) V1 of a part of the surface of the photosensitive drum 1*a*, which is exposed by the laser scanner 3*a*, becomes −200 V.

A "developing contrast" herein refers to a value obtained by subtracting an absolute value of the image portion potential V1 from an absolute value of the direct current component Vdc of the developing bias, and when this value is large, a large amount of toner having an original charging polarity (toner having a negative charging polarity) moves toward a part having the image portion potential from the developing sleeve. Further, a "fog-removing contrast Vback" refers to a value obtained by subtracting an absolute value of the direct current component Vdc of the developing bias from an absolute value of the background portion potential (dark point potential) Vd. When this value is small, a large amount of toner having a polarity (toner having a positive charging polarity) opposite to the original charging polarity moves toward a part having the background portion potential from the developing sleeve. In the first embodiment, the CPU 120 sets the developing contrast to 100 V and the fog-removing contrast Vback to 150 V.

In the image forming unit Sa controlled as described above, of the toner on the developing sleeve 42*a*, toner having the original charging polarity (negative charges) flies from Vdc in a direction of V1. Meanwhile, in the image forming unit Sa, the fogged toner flies from Vdc in a direction of the part having the background portion potential Vd. In image forming apparatus in recent years, toner deterioration is suppressed due to increase in toner property, and there is a decreasing trend of fogged toner.

Further, the CPU 120 also controls the primary transfer bias voltage of the primary transfer bias source 54*a*, the rotation speed of the intermediate transfer belt 51 rotated by the drive motor 521, and the secondary transfer bias voltage of the secondary transfer bias source 58. Further, the CPU 120 is configured to be capable of executing the control process for controlling each device based on a water content detected by a water content detection unit 60. The water content detection unit 60 is provided in the apparatus main body 101, and is configured to detect a water content (humidity ratio) in air inside of the apparatus main body 101 (apparatus main body).

[Control Flow]

Figure 4:
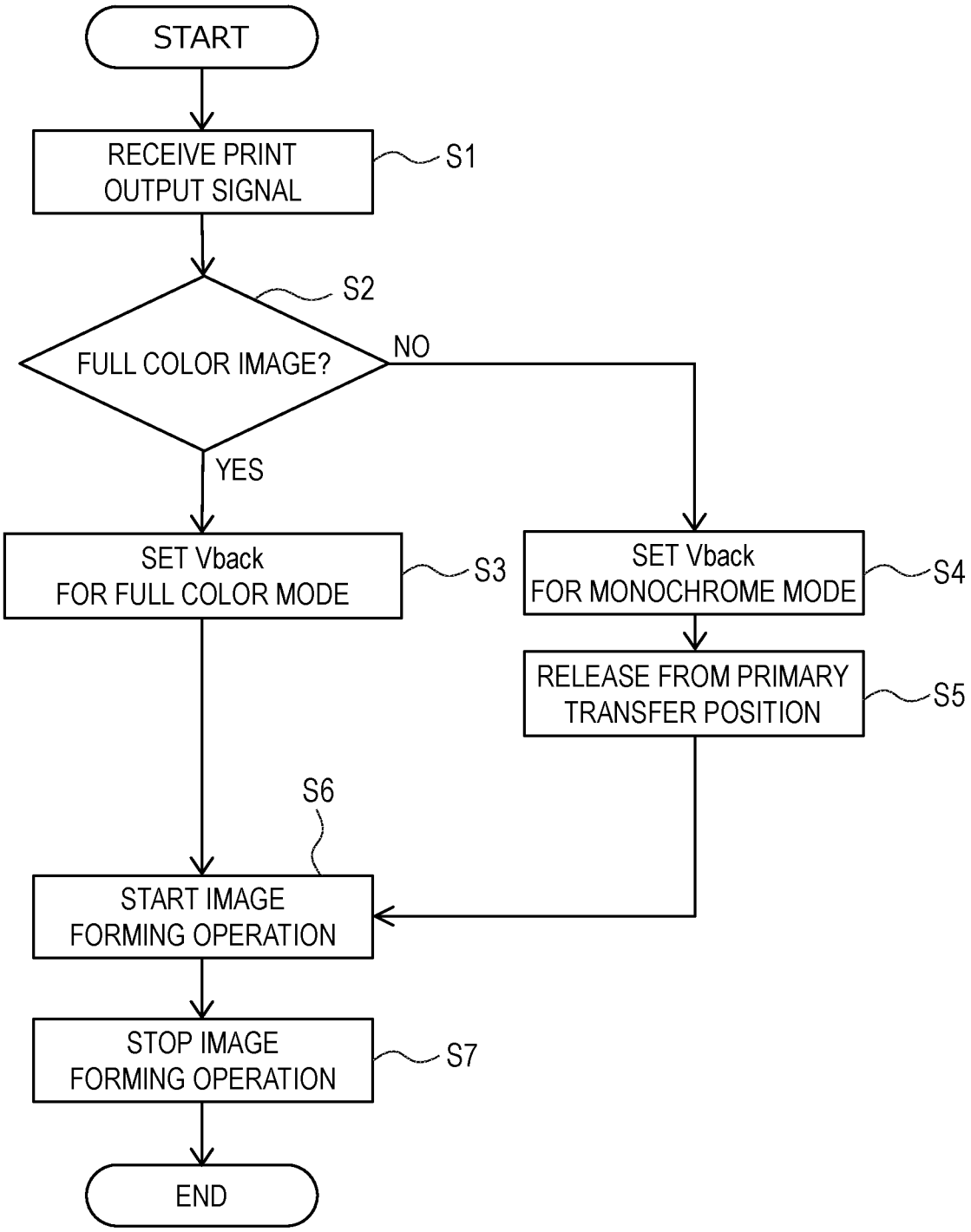
FIG. 4 is a flow chart for illustrating a control process in the first embodiment.

FIG. 4 is a flow chart for illustrating processing related to image formation to be executed by the CPU 120. As illustrated in FIG. 4, in the image forming operation, first, the CPU 120 receives a print output signal transmitted from a controller (not shown) of, for example, a reader, a facsimile machine, or a PC (Step S1). Next, the CPU 120 analyzes the received print output signal to determine whether the image to be formed is a full color image or a black monochrome image (Step S2). In this processing, when the print output signal received in the processing of Step S1 is a signal related to formation of the full color image, the CPU 120 determines to set a full color mode (first image forming mode), in which a full color image is formed with use of the image forming units Sa to Sd. Meanwhile, when the print output signal received in the processing of Step S1 is a signal related to formation of the black monochrome image, the CPU 120 determines to set a monochrome mode (second image forming mode), in which a black monochrome image is formed with use of only the image forming unit Sd.

When the CPU 120 determines to form the full color image in the processing of Step S2 (Yes), the CPU 120 executes processing of setting the fog-removing contrast Vback of the image forming units Sa to Sd (Step S3). When the full color image is to be formed, the CPU 120 in the first embodiment sets the charging bias voltage so that the potential (background portion potential) Vd of the surfaces of the photosensitive drums 1*a* to 1*d* on positions (developing positions) at which the photosensitive drums 1*a* to 1*d* are opposed to the developing sleeves 42*a* to 42*d* satisfies Vd=−650 V. Further, the CPU 120 sets the direct current component of the developing bias voltage so that the direct current component Vdc of the potential of the surfaces of the developing sleeves 42*a* to 42*d* on the developing positions satisfies Vdc=−500 V. In this manner, the CPU 120 sets the fog-removing contrast (potential difference) Vback so as to satisfy Vback=150 V.

Meanwhile, when the CPU 120 determines to form the black monochrome image in the processing of Step S2 (No), the CPU 120 executes processing of setting the fog-removing contrast Vback of the image forming unit Sd (Step S4). In this processing, when the black monochrome image is to be printed, the CPU 120 in the first embodiment sets the background portion potential Vd of the surface of the photosensitive drum 1*d* on the developing position to be smaller than that for the full color mode. That is, the CPU 120 sets the charging bias voltage so that the background portion potential Vd=−650 V of the photosensitive drum 1*d* on the developing position at the time of the full color mode is changed to satisfy Vd=−600 V. Further, the CPU 120 sets the direct current component of the developing bias voltage so that the direct current component Vdc of the potential (developing potential) of the surface of the developing sleeve 42*d* on the developing position satisfies Vdc=−500 V. Thus, the fog-removing contrast Vback is set to satisfy Vback=100 V.

Figure 5:
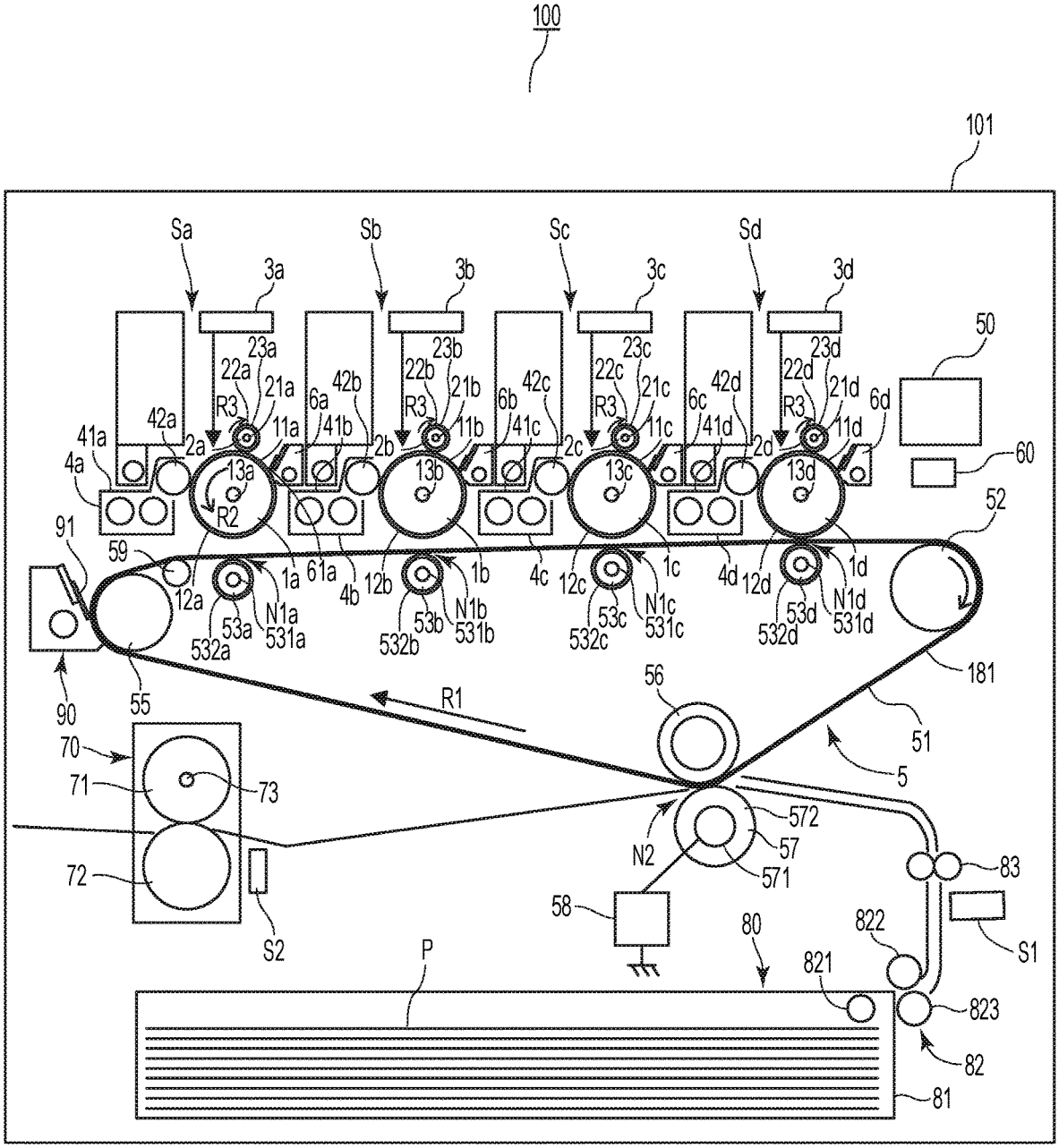
FIG. 5 is a schematic configuration view for illustrating the image forming apparatus under a state in which a part of image forming units is released from an intermediate transfer member.

Next, the CPU 120 releases the primary transfer portions N1*a* to N1*c* from the intermediate transfer belt 51 (Step S5). FIG. 5 is a schematic configuration view for illustrating the image forming apparatus 100 in a case of the monochrome mode. As illustrated in FIG. 5, the CPU 120 causes a cam (not shown) to turn to move the guide roller 59 inside of the intermediate transfer unit 5 downward in FIG. 5. When the guide roller 59 is moved downward in FIG. 5, in the image forming apparatus 100, the image forming units Sa to Sc not to be used for image formation are released from the intermediate transfer belt 51 so that the primary transfer portions N1*a* to N1*c* are prevented from being formed. In this manner, in the image forming apparatus 100, the photosensitive drums 1*a* to 1*c* are not required to be rotated. Thus, consumption of the photosensitive drums 1*a* to 1*c* can be suppressed, and the lifetimes of the photosensitive drums 1*a* to 1*c* can be increased. That is, in the monochrome mode, the drive of the photosensitive drums 1*a* to 1*c* is stopped, and further the drive of the developing sleeves 42*a* to 42*c* is stopped. In this manner, deterioration of the photosensitive drums and the developer can be suppressed.

The CPU 120, which is configured to release the photosensitive drums 1*a* to 1*c* of the image forming units Sa to Sc from the outer peripheral surface of the intermediate transfer belt 51 to perform switching between the full color mode and the monochrome mode, functions as a switching unit in the first embodiment. Further, the photosensitive drums 1*a* to 1*c* to be brought into abutment against the outer peripheral surface of the intermediate transfer belt 51 at the time of the full color mode function as a first photosensitive member, and the image forming units Sa to Sc function as a first image forming unit. Further, the toner images formed on the photosensitive drums 1*a* to 1*c* correspond to a first toner image. Further, the photosensitive drum 1*d* to be brought into abutment against the outer peripheral surface of the intermediate transfer belt 51 at the time of the monochrome mode functions as a second photosensitive member, and the charging roller 2*d* configured to charge the photosensitive drum 1*d* to have a predetermined surface potential functions as a charging member. The laser scanner 3*d* constructs an exposure device. Further, the developing sleeve 42*d* functions as a developing device, and the image forming unit Sd functions as a second image forming unit. The charging bias source 24*d* (see FIG. 2) functions as a charging source, and the developing bias source 48*d* (see FIG. 2) functions as a developing source. Further, the toner image formed on the photosensitive drum 1*d* corresponds to a second toner image.

After the processing of Step S3 or Step S5 is executed, the CPU 120 starts formation of an image on the recording material P by the image forming apparatus 100 (Step S6). Then, the CPU 120 performs idling until a predetermined time period elapses and thereafter stops as an ending processing (Step S7) of, for example, removing the transfer residual toner or eliminating charges on the surfaces of the photosensitive drums 1*a* to 1*d* after the image formation is ended.

As described above, the CPU 120 in the first embodiment can execute the image formation in the full color mode and the image formation in the monochrome mode. Further, the CPU 120 is configured to be capable of setting the fog-removing contrast Vback for the monochrome mode to be smaller than the fog-removing contrast Vback for the full color mode. This CPU 120 functions as a setting unit in the first embodiment.

[Relationship Between Fog-Removing Contrast and Toner Fogging Amount]

In the image forming apparatus 100, in general, there is a tendency that curling, abnormal abrasion, and chattering (abnormal vibration) of the cleaning blade 91 are more likely to occur when the image is formed in the monochrome mode as compared to when the image is formed in the full color mode. This is because, when the image is formed in the full color mode, fogged toners for four colors are supplied to the cleaning blade 91, but when the image is formed in the monochrome mode, only a fogged toner for one color is supplied to the cleaning blade 91.

Figure 6:
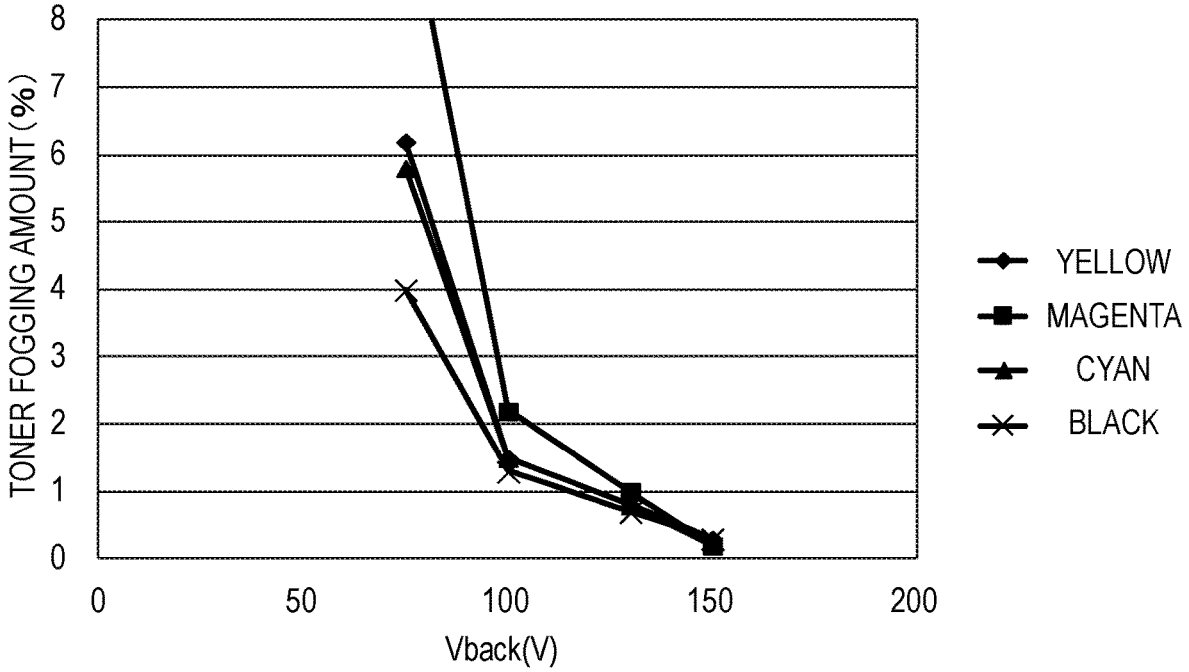
FIG. 6 is a graph for showing a toner fogging amount for each potential difference between the charging potential and the developing potential.

FIG. 6 is a graph for showing an amount of fogged toner (toner fogging amount) with respect to the fog-removing contrast Vback of each color. In this case, the toner fogging amount (%) is 0% under a state in which there is no toner, and has such a unit that the ratio is increased as the toner concentration is increased.

As shown in FIG. 6, in the image forming apparatus 100, the fogged toner of each color is generated, and the toner fogging amount changes depending on the value of the fog-removing contrast Vback. In the image forming apparatus 100, for example, when the fog-removing contrast Vback in the full color mode is 150 V, four-color fogged toners of about 1% in total are supplied to the cleaning blade 91.

As shown in FIG. 6, in the image forming apparatus 100, when the fog-removing contrast Vback of the image forming unit Sd is set to about 100 V, fogged toner of about 1% can be supplied even in the monochrome mode. In this manner, in the image forming apparatus 100, substantially the same amount of fogged toner as that in the full color mode can be supplied to the cleaning blade 91 even in the monochrome mode. In the image forming apparatus 100, the fog-removing contrast Vback of the image forming unit Sd is set to about 100 V so that a larger amount of fogged toner is generated in the monochrome mode as compared to the fogged toner generated from the image forming unit Sd at the time of the full color mode. However, in the image forming apparatus 100, as described above, the total amount of fogged toner is substantially the same between the full color mode and the monochrome mode, and hence the fogged toner generated from the image forming unit Sd hardly affects the image formation.

[Test of Effect of Changing Fog-Removing Contrast]

Next, results of testing effects for curling of the cleaning blade 91 when the fog-removing contrast Vback of the image forming unit Sd is set to 100 V in the monochrome mode are described with reference to Conventional Example and Comparative Examples. In order to test the effects for the curling of the cleaning blade 91, as the image forming apparatus, imageRUNNER ADVANCE C5255 manufactured by Canon Inc. was used. Further, the effects were tested under conditions such as a process speed of 250 mm/s, an image density of about 4%, an image forming mode of successive duplex-printing of 10,000 sheets, and a peripheral environment around the image forming apparatus main body of 30° C. in temperature and 80% in humidity.

Further, the toner fogging amount was measured by, first, obtaining a reflection density of each of a sample (α) obtained by sampling the fogged toner on the surface of the photosensitive drum when an image was not formed with use of a transparent PET tape and bonding the PET tape to white paper and a sample (β) obtained by bonding the same PET tape to white paper. Then, the reflection density of β was subtracted from the reflection density of α, and thus the toner fogging amount was calculated. Further, DENSITOMETER TC-6MC-D manufactured by Tokyo Denshoku CO., LTD. was used for measuring the reflection density.

In the First Embodiment, untransferred toner is not periodically supplied to the cleaning blade, and the fog-removing contrast Vback is set to 100 V. Further, in the Conventional Example, untransferred toner is not periodically supplied to the cleaning blade, and the fog-removing contrast Vback is set to 150 V. Further, in Comparative Example 1, every time images are formed on 100 recording materials, untransferred toner of 10 mm in a sub scanning direction is supplied to the cleaning blade, and the fog-removing contrast Vback is set to 150 V. Further, in Comparative Example 2, every time images are formed on 30 recording materials, untransferred toner of 10 mm in the sub scanning direction is supplied to the cleaning blade, and the fog-removing contrast Vback is set to 150 V. Further, in Comparative Example 3, untransferred toner is not periodically supplied to the cleaning blade, and the fog-removing contrast Vback is set to 130 V.

In the image forming apparatus 100 according to the first embodiment, when the fog-removing contrast Vback in the monochrome mode is set to be different from that for the full color mode, the charging bias voltage of the charging roller 2*d* is changed. For example, the image forming apparatus 100 decreases the charging bias voltage when the fog-removing contrast Vback is decreased from 150 V to 100 V. The image forming apparatus 100 adjusts the output of the laser scanner 3*d* so that the image portion potential V1 does not vary in response to a deceased amount of developing contrast being the difference between the image portion potential V1 and the direct current component Vdc of the developing bias voltage, which has been deceased in response to the decreased charging bias.

FIG. 7 is a table for showing results of test in the First Embodiment, the Conventional Example, and Comparative Examples 1 to 3. As shown in FIG. 7, in the Conventional Example and Comparative Examples 1 and 3, a cleaning blade curl was generated. Further, in Comparative Example 2, although the cleaning blade curl was not generated, a large amount of untransferred toner was supplied to the cleaning blade, and thus a large amount of toner not to be used for image formation was consumed. As a result, in Comparative Example 2, the number of recording materials P on which printing was enabled with one toner bottle was excessively decreased as compared to other test results of the First Embodiment and the Conventional Example.

In contrast, in the First Embodiment, the cleaning blade curl was able to be prevented without consumption of a large amount of toner unlike Comparative Example 2, while high productivity was maintained.

As described above, the image forming apparatus 100 according to the first embodiment is configured to be capable of setting the fog-removing contrast Vback in the monochrome mode to be smaller than the fog-removing contrast Vback in the full color mode. Therefore, in the image forming apparatus 100, the toner fogging amount generated from the image forming unit Sd can be substantially the same as the total toner fogging amount generated from the image forming units Sa to Sd in the full color mode. In this manner, the image forming apparatus 100 can supply a sufficient amount of fogged toner to the cleaning blade 91 even in the monochrome mode, and thus it is possible to suppress occurrence of curling, abnormal vibration, and abrasion of the cleaning blade 91 due to the unstable abutment state of the cleaning blade 91.

Second Embodiment

Next, an image forming apparatus 100 according to a second embodiment of the present invention is described. In the image forming apparatus 100 according to the second embodiment, the fog-removing contrast Vback for the monochrome mode is changed from the fog-removing contrast Vback for the full color mode based on the water content in the apparatus main body 101, which is detected by the water content detection unit 60. The image forming apparatus 100 according to the second embodiment differs from the above-mentioned image forming apparatus 100 according to the first embodiment in this point. Other configurations are similar to those in the first embodiment. Therefore, components in common with those in the first embodiment are denoted by the same reference symbols, and description thereof is omitted.

[Control Flow]

Figure 8:
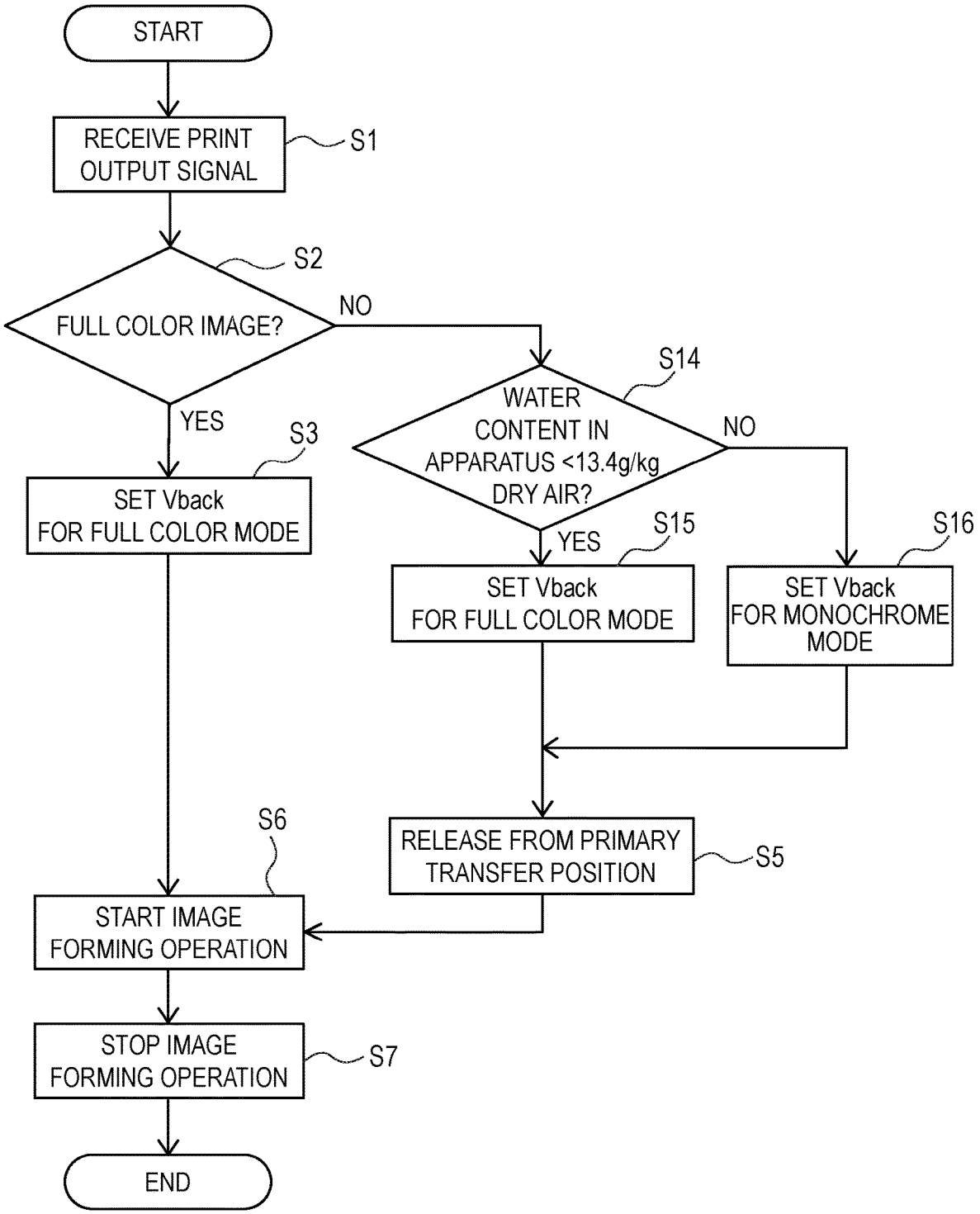
FIG. 8 is a flow chart for illustrating a control process in a second embodiment of the present invention.

FIG. 8 is a flow chart for illustrating processing related to image formation to be executed by the CPU 120 in the second embodiment. In the flow chart of FIG. 8, processing similar to the processing executed by the CPU 120 in the first embodiment, which is illustrated in FIG. 4, is denoted by the same step number, and description thereof is omitted.

When the CPU 120 determines that the analyzed print signal is a signal related to formation of a black monochrome image (No in Step S2), the CPU 120 determines whether or not the water content in the apparatus main body 101, which is detected by the water content detection unit 60, is smaller than 13.4 g/KgDryAir (Step S14). Note that the value of 13.4 g/KgDryAir is a numerical example and can be changed appropriately.

It is generally known that a phenomenon in which the cleaning blade 91 curls is more likely to occur in a high-temperature and high-humidity environment than in a low-temperature and low-humidity environment. There is a tendency that the surface of the intermediate transfer belt 51 is activated through application of the transfer biases at the primary transfer portions N1*a* to N1*d* and the secondary transfer portion N2, and the frictional force between the cleaning blade 91 and the intermediate transfer belt 51 is increased when surrounding moisture or the like adheres to the surface. Further, there is a tendency that, when the temperature is increased, the repulsion elasticity of the cleaning blade 91 is increased, and the sliding property at the time of abutment against the intermediate transfer belt 51 is decreased. Thus, in the image forming apparatus 100, the phenomenon in which the cleaning blade 91 curls is likely to occur when the temperature and the humidity inside of the apparatus main body 101 are increased.

In view of the above-mentioned circumstance, in the image forming apparatus 100, the frictional force between the cleaning blade 91 and the intermediate transfer belt 51 with respect to the water content inside of the apparatus main body 101 is measured in advance, and a data table that is based on a result of the measurement is formed and stored in the ROM 121. In the image forming apparatus 100 according to the second embodiment, the ROM 121 stores therein a data table in which the water content in air inside of the apparatus main body 101, which is detected by the water content detection unit 60, of 13.4 g/KgDryAir (predetermined water content) is a threshold value for determination.

When it is determined that the water content in the apparatus main body 101 is smaller than 13.4 g/KgDryAir in the processing of Step S14 (Yes), the CPU 120 sets the same fog-removing contrast Vback as that for the full color mode (Step S15). In the processing of Step S15, the CPU 120 sets the fog-removing contrast Vback similar to that in the processing of Step S3. That is, the CPU 120 sets the charging bias voltage and the direct current component of the developing bias voltage so that the background portion potential Vd of the surface of the photosensitive drum 1*d* on the developing position satisfies Vd=−650 V and so that the direct current component Vdc of the potential of the surface of the developing sleeve 42*d* on the developing position satisfies Vdc=−500 V. In this manner, in the image forming apparatus 100, when the water content in the apparatus main body 101 is smaller than 13.4 g/KgDryAir, the fog-removing contrast Vback is set to satisfy Vback=150 V. Therefore, in the image forming apparatus 100, the fogged toner is supplied only from the image forming unit Sd, and hence fogged toner of substantially ¼ of that at the time of the full color mode is supplied to the cleaning blade 91.

Meanwhile, when it is determined that the water content in the apparatus main body 101 is equal to or larger than 13.4 g/KgDryAir in the processing of Step S14 (No), the CPU 120 sets the fog-removing contrast Vback for the monochrome mode (Step S16). In the processing of Step S16, the CPU 120 sets the charging bias voltage so that the background portion potential Vd of the surface of the photosensitive drum 1*d* on the developing position satisfies Vd=−600 V. Further, the CPU 120 sets the direct current component of the developing bias voltage so that the direct current component Vdc of the potential of the surface of the developing sleeve 42*d* on the developing position satisfies Vdc=−500 V. In this manner, in the image forming apparatus 100, when the water content in the apparatus main body 101 is equal to or larger than 13.4 g/KgDryAir, the fog-removing contrast Vback is set to satisfy Vback=100 V. Therefore, in the image forming apparatus 100, although the fogged toner is supplied only from the image forming unit Sd, substantially the same amount of fogged toner as the total amount of fogged toners supplied at the time of the full color mode is supplied to the cleaning blade 91.

As described above, in the image forming apparatus 100 according to the second embodiment, when the water content in the apparatus main body 101 is equal to or larger than a predetermined water content, the fog-removing contrast Vback in the monochrome mode is set to be smaller than that for the full color mode. Therefore, in the image forming apparatus 100, under a high-temperature and high-humidity state, in which the abutment state of the cleaning blade 91 is likely to become unstable, the toner fogging amount at the time of the monochrome mode can be made substantially the same as the total toner fogging amount at the time of the full color mode. In this manner, the image forming apparatus 100 can supply a sufficient amount of fogged toner to the cleaning blade 91 even at the time of the monochrome mode in the high-temperature and high-humidity state, and can suppress occurrence of curling, abnormal vibration, and abrasion of the cleaning blade 91 due to the unstable abutment state of the cleaning blade 91.

Further, under a low-temperature and low-humidity state, in which the water content in the apparatus main body 101 is smaller than the predetermined water content, the image forming apparatus 100 sets the fog-removing contrast Vback in the monochrome mode to be the same as that for the full color mode. In this manner, under the low-temperature and low-humidity state, in which the abutment state of the cleaning blade 91 is stable, the image forming apparatus 100 can prevent the toner fogging amount to be supplied from the image forming unit Sd from being increased, to thereby prevent toner from being excessively consumed.

Third Embodiment

Next, an image forming apparatus 100 according to a third embodiment of the present invention is described. In the image forming apparatus 100 according to the third embodiment, the fog-removing contrast Vback for the monochrome mode is changed from the fog-removing contrast Vback for the full color mode based on the drive torque of the intermediate transfer belt 51. The image forming apparatus 100 according to the third embodiment differs from the above-mentioned image forming apparatus 100 according to the first and second embodiments in this point. Other configurations are similar to those in the first and second embodiments. Therefore, components in common with those in the first and second embodiments are denoted by the same reference symbols, and description thereof is omitted.

In the image forming apparatus 100, the drive torque of the intermediate transfer belt 51 is affected by the friction between the intermediate transfer belt 51 and an object to be brought into abutment against the surface of the intermediate transfer belt 51, such as the cleaning blade 91, the photosensitive drums 1*a* to 1*d*, or the secondary transfer outer roller 57. In particular, the drive torque of the intermediate transfer belt 51 is significantly affected by the friction between the intermediate transfer belt 51 and the cleaning blade 91. In the third embodiment, the CPU 120 measures an amount of current to be supplied to the drive motor 521 to detect the drive torque of the intermediate transfer belt 51. The CPU 120 functions as a drive detection unit configured to detect a value related to the drive torque in the third embodiment.

Figure 9:
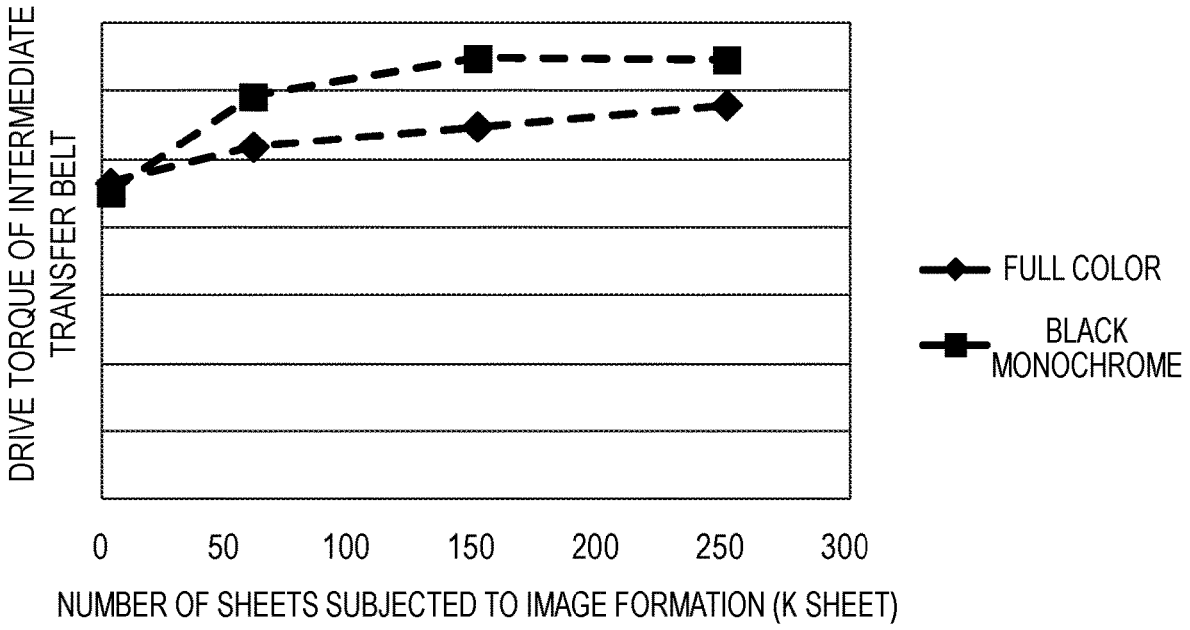
FIG. 9 is a graph for showing a relationship between a drive torque of an intermediate transfer member and a number of sheets subjected to image formation in a third embodiment of the present invention.

FIG. 9 is a graph for showing a relationship between the drive torque of the intermediate transfer belt 51 and a number of sheets subjected to image formation. As shown in FIG. 9, the drive torque of the intermediate transfer belt 51 at the time of start of usage of the intermediate transfer belt 51 is lower than that after the number of sheets subjected to image formation is increased. This is because, when the number of sheets subjected to image formation is increased, the friction coefficient of the surface of the intermediate transfer belt 51 is increased due to, for example, the smoothed surface of the intermediate transfer belt 51, a toner component or a transfer agent component adhering on the surface of the intermediate transfer belt 51, or deterioration caused by discharge.

Further, there is a tendency that the drive torque of the intermediate transfer belt 51 is increased more in the case of the monochrome mode as compared to the case of the full color mode. This is because, as described above, the amount of fogged toner to be supplied to the cleaning blade 91 is reduced in the monochrome mode as compared to that in the full color mode, and hence the frictional force between the cleaning blade 91 and the intermediate transfer belt 51 is increased.

When the drive torque is increased, in the image forming apparatus 100, the cleaning blade 91 is more likely to curl. In the image forming apparatus 100 according to the third embodiment, when the drive torque of the intermediate transfer belt 51 is equal to or larger than a predetermined value at which the cleaning blade 91 is likely to curl, the fog-removing contrast Vback in the monochrome mode is set to be smaller than that for the full color mode.

With this configuration, in the image forming apparatus 100, under a high-drive-torque state, in which the abutment state of the cleaning blade 91 is likely to become unstable, the toner fogging amount at the time of the monochrome mode can be made substantially the same as the total toner fogging amount at the time of the full color mode. In this manner, the image forming apparatus 100 can supply a sufficient amount of fogged toner to the cleaning blade 91 even at the time of the monochrome mode in the high-drive-torque state, and can suppress occurrence of curling, abnormal vibration, and abrasion of the cleaning blade 91 due to the unstable abutment state of the cleaning blade 91.

Further, under a state in which the drive torque of the intermediate transfer belt 51 is low, the image forming apparatus 100 sets the fog-removing contrast Vback in the monochrome mode to be the same as that for the full color mode. In this manner, under a low-drive-torque state, in which the abutment state of the cleaning blade 91 is stable, the image forming apparatus 100 can prevent the toner fogging amount to be supplied from the image forming unit Sd from being increased, to thereby prevent toner from being excessively consumed.

Fourth Embodiment

Next, an image forming apparatus 100 according to a fourth embodiment of the present invention is described. In the image forming apparatus 100 according to the fourth embodiment, the fog-removing contrast Vback for the monochrome mode is changed from the fog-removing contrast Vback for the full color mode based on the number of sheets subjected to image formation from the start of usage of the intermediate transfer belt 51. The image forming apparatus 100 according to the fourth embodiment differs from the above-mentioned image forming apparatus 100 according to the first to third embodiments in this point. Other configurations are similar to those in the first to third embodiments. Therefore, components in common with those in the first to third embodiments are denoted by the same reference symbols, and description thereof is omitted.

[Control Flow]

Figure 10:
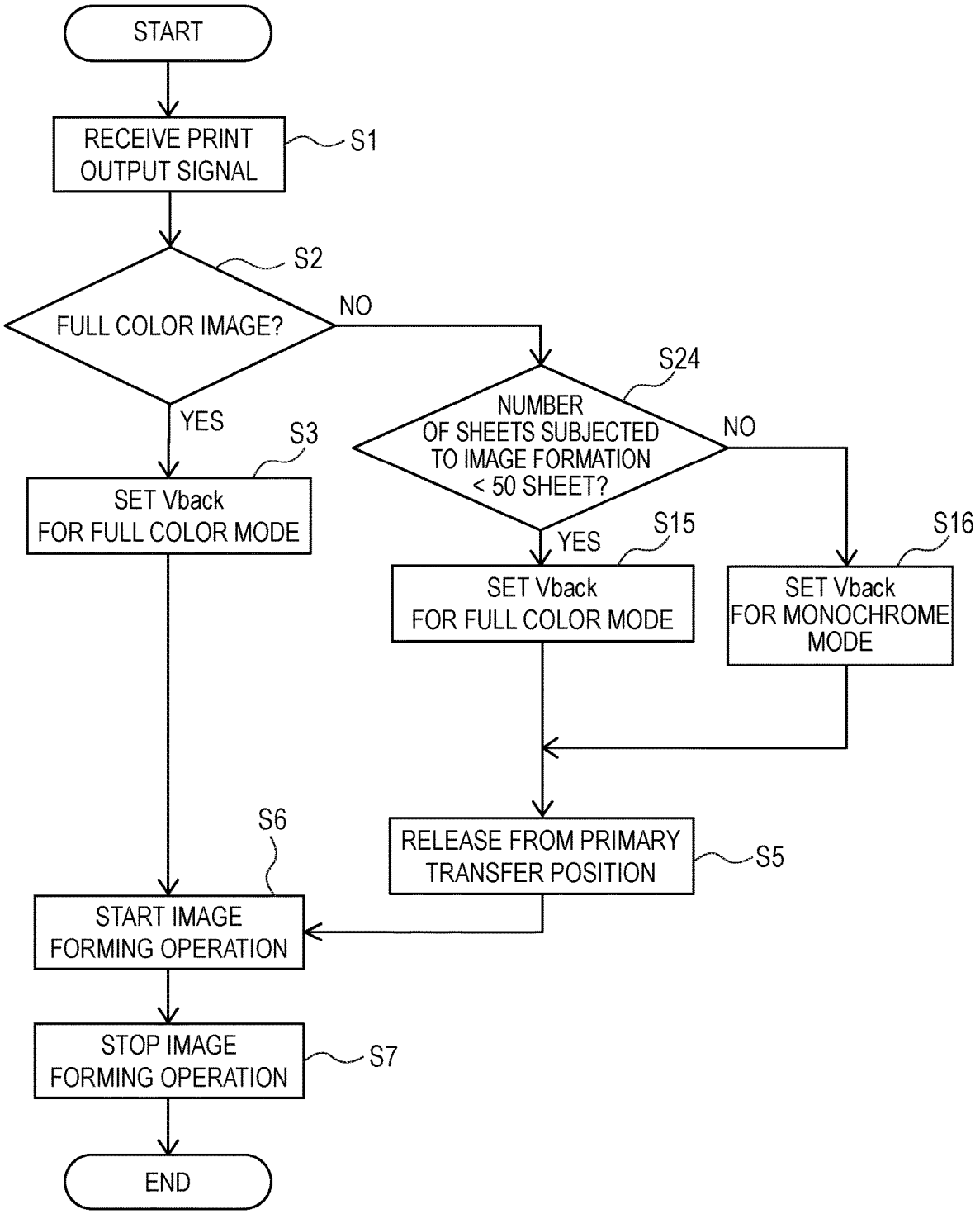
FIG. 10 is a flow chart for illustrating a control process in a fourth embodiment of the present invention.

FIG. 10 is a flow chart for illustrating processing related to image formation to be executed by the CPU 120 in the fourth embodiment. In the flow chart of FIG. 10, processing similar to the processing executed by the CPU 120 in the first embodiment, which is illustrated in FIG. 4, and the processing executed by the CPU 120 in the second embodiment, which is illustrated in FIG. 8, is denoted by the same step number, and description thereof is omitted.

When the CPU 120 determines that the analyzed print signal is a signal related to formation of a black monochrome image (No in Step S2), the CPU 120 determines whether or not the number of sheets subjected to image formation is less than 50,000.

As described above, in the image forming apparatus 100, as the number of sheets subjected to image formation from the start of usage of the intermediate transfer belt 51 is increased, the surface of the intermediate transfer belt 51 is deteriorated. Further, in the image forming apparatus 100, the frictional force between the cleaning blade 91 and the intermediate transfer belt 51 is increased, and the phenomenon in which the cleaning blade 91 curls is more likely to occur.

In view of the above-mentioned circumstance, in the image forming apparatus 100, the transition of the frictional force of the intermediate transfer belt 51 is measured in advance, and a data table that is based on a result of the measurement is formed and stored in the ROM 121. In the image forming apparatus 100 according to the fourth embodiment, the ROM 121 stores therein a data table in which the number of sheets subjected to image formation from the start of usage of the intermediate transfer belt 51 of 50,000 (predetermined number) is a threshold value for determination.

When it is determined that the number of sheets subjected to image formation is less than 50,000 in the processing of Step S24 (Yes), the CPU 120 sets the same fog-removing contrast Vback as that for the full color mode (Step S15). In the processing of Step S15, the CPU 120 sets the fog-removing contrast Vback similar to that in the processing of Step S3. That is, the CPU 120 sets the charging bias voltage and the direct current component of the developing bias voltage so that the background portion potential Vd of the surface of the photosensitive drum 1*d* on the developing position satisfies Vd=−650 V and so that the direct current component Vdc of the potential of the surface of the developing sleeve 42*d* on the developing position satisfies Vdc=−500 V. In this manner, in the image forming apparatus 100, when the water content in the apparatus main body 101 is smaller than 13.4 g/KgDryAir, the fog-removing contrast Vback is set to satisfy Vback=150 V. Therefore, in the image forming apparatus 100, the fogged toner is supplied only from the image forming unit Sd, and hence fogged toner of substantially ¼ of that at the time of the full color mode is supplied to the cleaning blade 91.

Meanwhile, when it is determined that the number of sheets subjected to image formation is equal to or larger than 50,000 in the processing of Step S24 (No), the CPU 120 sets the fog-removing contrast Vback for the monochrome mode (Step S16). In the processing of Step S16, the CPU 120 sets the charging bias voltage so that the background portion potential Vd of the surface of the photosensitive drum 1*d* on the developing position satisfies Vd=−600 V. Further, the CPU 120 sets the direct current component of the developing bias voltage so that the direct current component Vdc of the potential of the surface of the developing sleeve 42*d* on the developing position satisfies Vdc=−500 V. In this manner, in the image forming apparatus 100, when the number of sheets subjected to image formation is equal to or larger than 50,000, the fog-removing contrast Vback is set to satisfy Vback=100 V. Therefore, in the image forming apparatus 100, although the fogged toner is supplied only from the image forming unit Sd, substantially the same amount of fogged toner as the total amount of fogged toners supplied at the time of the full color mode is supplied to the cleaning blade 91.

As described above, when the number of sheets subjected to image formation from the start of usage of the intermediate transfer belt 51 is equal to or larger than the predetermined number, the image forming apparatus 100 according to the fourth embodiment sets the fog-removing contrast Vback in the monochrome mode to be smaller than that for the full color mode. Therefore, in the image forming apparatus 100, under a state in which the number of sheets subjected to image formation is large and the surface of the intermediate transfer belt 51 is deteriorated, the toner fogging amount at the time of the monochrome mode can be made substantially the same as the total toner fogging amount at the time of the full color mode. In this manner, the image forming apparatus 100 can supply a sufficient amount of fogged toner to the cleaning blade 91 even at the time of the monochrome mode under the state in which the surface of the intermediate transfer belt 51 is deteriorated and thus the abutment state of the cleaning blade 91 is likely to become unstable. Further, the image forming apparatus 100 can suppress occurrence of curling, abnormal vibration, and abrasion of the cleaning blade 91 due to the unstable abutment state of the cleaning blade 91.

Further, under a state in which the number of sheets subjected to image formation from the start of usage of the intermediate transfer belt 51 is smaller than the predetermined number, the image forming apparatus 100 sets the fog-removing contrast Vback in the monochrome mode to be the same as that for the full color mode. In this manner, under a state in which the abutment state of the cleaning blade 91 is stable and before the surface of the intermediate transfer belt 51 is deteriorated, the image forming apparatus 100 can prevent the toner fogging amount to be supplied from the image forming unit Sd from being increased to prevent toner from being excessively consumed.

OTHER EMBODIMENTS

In the first to fourth embodiments, the CPU 120 decreases the background portion potential Vd in order to set the fog-removing contrast Vback for the monochrome mode to be smaller than that for the full color mode, but the present invention is not limited thereto. The CPU 120 may set the direct current component Vdc of the developing potential at the time of the monochrome mode to be a potential that is larger than that at the time of the full color mode so as to set the fog-removing contrast Vback for the monochrome mode to be smaller than that for the full color mode. Further, the CPU 120 may change both of Vd and the direct current component Vdc of the developing potential at the time of the monochrome mode so as to set the fog-removing contrast Vback for the monochrome mode to be smaller than that for the full color mode.

Further, the image forming apparatus 100 according to each of the first to fourth embodiments executes, as the first image forming mode, the full color mode, in which the image forming units Sa to Sd are used, and, as the second image forming mode, the black monochrome mode, in which the image forming unit Sd is used. However, the present invention is not limited thereto. As long as the image forming apparatus 100 is configured to be capable of executing a mode in which an image is formed with use of any one of the image forming units Sa to Sd as the second image forming mode, the color may be any color, and is not limited to black.

Further, in the first embodiment, the CPU 120 sets the fog-removing contrast Vback for the monochrome mode to be always smaller than that for the full color mode (first setting mode).

However, the image forming apparatus 100 may be configured to be capable of executing each of the above-mentioned first setting mode and a setting mode (second setting mode) in which the same fog-removing contrast Vback is set for the monochrome mode and for the full color mode so that an operator can select the mode. That is, the apparatus may include an operation unit 123 (FIG. 2) capable of receiving manual input, and the operator may select the mode through the operation unit 123. Further, the operation unit 123 may be configured to enable adjustment of the fog-removing contrast Vback for the monochrome mode and the fog-removing contrast Vback for the full color mode separately. The CPU 120 may be capable of selectively executing at least the first setting mode and the second setting mode from among a plurality of setting modes based on information input from the operation unit 123.

Further, in the fourth embodiment, the CPU 120 is configured to change the fog-removing contrast Vback in the monochrome mode from that for the full color mode in accordance with the number of sheets subjected to image formation from the start of usage of the intermediate transfer belt 51, but the present invention is not limited thereto. The CPU 120 may be configured to change the fog-removing contrast Vback in the monochrome mode from that for the full color mode in accordance with a parameter related to deterioration of the surface of the intermediate transfer belt 51. Specifically, the CPU 120 may be configured to change the fog-removing contrast Vback in the monochrome mode with use of parameters such as a running distance from the start of usage of the intermediate transfer belt 51 and a high-voltage application time from the start of usage of the intermediate transfer belt 51.

Further, in the fourth embodiment, the CPU 120 executes control of changing the fog-removing contrast Vback in the monochrome mode with a predetermined number (50,000) of sheets subjected to image formation from the start of usage of the intermediate transfer belt 51 being set as the threshold value, but the present invention is not limited thereto. The CPU 120 may be configured to execute the control of changing the toner fogging amount at the time of the monochrome mode in a stepwise manner in accordance with the number of sheets subjected to image formation from the start of usage of the intermediate transfer belt 51.

Specifically, the image forming apparatus 100 causes the ROM 121 to store in advance a specific data table for controlling the background portion potential Vd so that the fog-removing contrast Vback for the monochrome mode is decreased in accordance with the number of sheets subjected to image formation from the start of usage of the intermediate transfer belt 51. Then, the CPU 120 reads out the specific data table from the ROM 121 when the image is formed in the monochrome mode to set the background portion potential Vd, to thereby decrease the fog-removing contrast Vback in accordance with the number of sheets subjected to image formation. With this configuration, the image forming apparatus 100 can supply an appropriate amount of fogged toner, which corresponds to the number of sheets subjected to image formation from the start of usage of the intermediate transfer belt 51, to the cleaning blade 91 at the time of the monochrome mode.

According to the embodiments of the present invention, an unstable abutment state of the cleaning blade can be suppressed when the second image forming mode is executed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-247049, filed Dec. 22, 2017, which is hereby incorporated by reference herein in its entirety.

What is claimed is:

1. An image forming apparatus comprising:

a first image forming unit including:

a first photosensitive member;

a first charging member configured to charge the first photosensitive member;

a first exposure device configured to expose the first photosensitive member to form an electrostatic image; and a first developing device configured to develop the electrostatic image formed on the first photosensitive member;

a second image forming unit including:

a second photosensitive member;

a second charging member configured to charge the second photosensitive member;

a second exposure device configured to expose the second photosensitive member to form an electrostatic image; and a second developing device configured to develop the electrostatic image formed on the second photosensitive member;

an endless intermediate transfer member, to which toner images formed on the first photosensitive member and the second photosensitive member are to be transferred;

a cleaning blade brought into abutment against an outer peripheral surface of the endless intermediate transfer member to remove toner on the endless intermediate transfer member; and a control unit configured to execute:

a first image forming mode, in which the first photosensitive member and the second photosensitive member are brought into abutment against the endless intermediate transfer member and image formation is executed; and a second image forming mode, in which the first photosensitive member is separated from the endless intermediate transfer member and the first photosensitive member and the first developing device stop driving, and the second photosensitive member is brought into abutment against the endless intermediate transfer member and image formation is executed, wherein the control unit is configured to set a potential difference, which is a difference between an absolute value of a dark point potential of the second photosensitive member charged by the second charging member and an absolute value of a direct current component of a developing bias to be applied to the second developing device, to have different values in the first image forming mode and the second image forming mode.

2. An image forming apparatus according to claim 1, wherein the control unit is configured to execute a setting mode in which the potential difference to be set in the first image forming mode is a first potential difference, and the potential difference to be set in the second image forming mode is a second potential difference, which is less than the first potential difference.

3. An image forming apparatus according to claim 1, further comprising a water content sensor configured to detect a water content in air inside of a main body of the image forming apparatus, wherein the control unit is configured to execute setting of the potential difference when the water content detected by the water content sensor is equal to or greater than a predetermined water content.

4. An image forming apparatus according to claim 1, further comprising a torque sensor configured to detect a value related to a drive torque of the endless intermediate transfer member, wherein the control unit is configured to execute setting of the potential difference when the value detected by the torque sensor is equal to or greater than a predetermined value.

5. An image forming apparatus according to claim 1, wherein the control unit is configured to execute setting of the potential difference when a number of sheets subjected to image formation from start of usage of the endless intermediate transfer member is equal to or greater than a predetermined number.

6. An image forming apparatus according to claim 1, further comprising an operation unit configured to receive manual input, wherein setting of the potential difference includes a first setting mode, wherein the control unit is configured to execute a second setting mode, in which the potential difference to be set in the first image forming mode is the same as the potential difference to be set in the second image forming mode, and wherein the control unit is configured to selectively execute the first setting mode and the second setting mode from among a plurality of setting modes based on input from the operation unit.

* * * * *